US006036188A

United States Patent [19]

Gomez et al.

[11] Patent Number: 6,036,188

[45] Date of Patent: Mar. 14, 2000

[54] AMUSEMENT GAME WITH PINBALL TYPE PLAYFIELD AND VIRTUAL VIDEO IMAGES

[75] Inventors: George A. Gomez, Evanston; Patrick Lawlor, Marengo, both of Ill.; Thomas W. Uban, Valparaiso, Ind.

[73] Assignee: Williams Electronic Games, Inc., Chicago, Ill.

[21] Appl. No.: 09/081,146

[22] Filed: May 19, 1998

[51] Int. Cl.[7] ..... A63D 3/00

[52] U.S. Cl. ..... 273/118 R; 463/34; 273/118 A; 273/127 A

[58] Field of Search ..... 463/1, 3, 30, 31, 463/32, 33, 34; 273/108, 108.1, 108.3, 108.4, 108.5, 118 R, 119 R, 127 R, 127 A, 127 B, 127 C, 127 D, 121 B, 121 A

[56] References Cited

U.S. PATENT DOCUMENTS

| | | | |
|---|---|---|---|
| 2,468,452 | 4/1949 | Leverenz | 250/164 |
| 2,845,618 | 7/1958 | Huffman | 340/369 |
| 3,549,803 | 12/1970 | Becht | 178/7.88 |
| 4,093,347 | 6/1978 | LaRussa | 350/174 |
| 4,189,145 | 2/1980 | Stubben et al. | 273/313 |
| 4,265,449 | 5/1981 | Reiner et al. | 273/108.1 |
| 4,305,095 | 12/1981 | Dallas | 358/88 |
| 4,306,768 | 12/1981 | Egging | 350/174 |
| 4,367,876 | 1/1983 | Kotoyori | 273/121 A |
| 4,371,164 | 2/1983 | Halliburton | 273/121 |
| 4,375,286 | 3/1983 | Seitz et al. | 273/121 |
| 4,421,317 | 12/1983 | Hector et al. | 273/313 |
| 4,448,417 | 5/1984 | Clark et al. | 273/121 A |
| 4,490,745 | 12/1984 | Erickson et al. | 358/250 |
| 4,710,873 | 12/1987 | Breslow et al. . | |
| 4,736,214 | 4/1988 | Rogers | 353/10 |
| 4,853,764 | 8/1989 | Sutter | 358/30 |
| 5,190,286 | 3/1993 | Watanabe et al. | 273/85 G |
| 5,221,083 | 6/1993 | Dote | 273/85 CP |
| 5,316,303 | 5/1994 | Trudeau et al. | 273/121 A |
| 5,327,284 | 7/1994 | Kuester | 359/479 |
| 5,351,966 | 10/1994 | Tohyama et al. | 273/311 |
| 5,417,422 | 5/1995 | Hansen | 273/121 A |
| 5,418,579 | 5/1995 | Jamieson et al. | 348/782 |
| 5,553,864 | 9/1996 | Sitrick | 463/31 |
| 5,639,151 | 6/1997 | McNelley et al. | 353/98 |
| 5,669,685 | 9/1997 | Kotani et al. | 353/28 |
| 5,685,625 | 11/1997 | Beaver | 353/28 |

FOREIGN PATENT DOCUMENTS

| | | | |
|---|---|---|---|
| 000559889 | 9/1993 | European Pat. Off. | 273/438 |
| 3023878 A1 | 6/1980 | Germany . | |
| 406339568 | 12/1994 | Japan | 273/118 R |
| 2 124 505 | 2/1984 | United Kingdom . | |
| 2124505 | 2/1984 | United Kingdom | A63D 13/00 |
| PCT/US83/01771 | 11/1983 | WIPO . | |
| WO 8401908 | 5/1984 | WIPO . | |

OTHER PUBLICATIONS

Website advertisement at www.recroom–amusements.com/crazyvaclav.htm, "Chicago Coin Super Flipper"; Rec Room Amusements; 1 pg; date unknown. Accessed May 7, 1999.

Description and drawings of 10 Pin Deluxe game, Williams Electronics Games, Inc., Chicago, Illinois, date unknown.

Description and photograph of Namco Redemption game, Namco, Ltd., Tokyo, Japan, date unknown.

Brochure for 10 Pin Deluxe Game, Midway Games Inc., Chicago, Illinois, prior to 1990 (date unknown).

*Primary Examiner*—Jessica J. Harrison

*Attorney, Agent, or Firm*—Arnold White & Durkee

[57] ABSTRACT

An amusement game which comprises a playfield having a game piece and a plurality of play features, and an apparatus for projecting a changeable virtual image in association with the playfield.

49 Claims, 5 Drawing Sheets

AMUSEMENT GAME WITH PINBALL TYPE PLAYFIELD AND VIRTUAL VIDEO IMAGES

FIELD OF THE INVENTION

This invention relates generally to amusement games, and more particularly, to an amusement game having a playfield for supporting a rolling ball and further having the capability of displaying a virtual image at a selectable position relative to the playfield.

BACKGROUND OF THE INVENTION

Amusement games such as pinball games and video games are often found together in arcades and other gaming establishments. The designers of these games strive to constantly provide innovations to continue to attract interest, both for attracting new players and for retaining the interest of present players.

In pinball games, generally speaking, a playfield upon which a rolling ball is supported is located in a generally horizontally disposed cabinet. The playfield is usually tilted or inclined at a slight angle to cause the ball to roll toward the end or bottom of the playfield, where the skilled player may use flippers to attempt to propel the ball back into the playfield area. A display for pinball games usually consists of an alphanumeric display for showing the score of one or more players. This display is usually mounted in a backbox which is mounted above the cabinet and generally at an end opposite the player position. The display may utilize electromechanical alphanumeric display elements or electrical or electronic illuminated display elements such as neon tubes or LEDs or the like. In some cases, so-called dot matrix display elements have been used to generate alphanumeric displays, and other somewhat limited visual displays.

Video games generally utilize a video display on a cathode ray tube (CRT) or equivalent device to, in effect, provide the "playfield" for the game. This, in effect, replaces the mechanical playfield and rolling ball of the pinball game. However, many types of game action can be displayed in video games.

Thus, generally speaking, video games have heretofore not provided an opportunity of using a playfield with a rolling ball and other mechanical or electromechanical elements with which the ball interacts in the playfield. On the other hand, pinball games have not heretofore provided the range and complexity of changeable visual effects or displays comparable with those available in video games. Moreover, the play action in pinball games has heretofore been restricted to interaction of the rolling ball with various playfield devices or play features in the playfield. That is, there has been no interaction of the ball with video generated images or features.

U.S. Pat. No. 4,375,286 to Seitz et al. incorporates a CRT screen mounted in the playfield to, in effect, incorporate a video game into the same cabinet with the pinball game. In the Seitz et al. patent, the pinball game and video game are described as essentially separate games. However, there is some provision for interaction between the video and pinball games, to the extent that achieving certain conditions during one or the other of the games might enable or initiate play in the other of the two games.

U.S. Pat. No. 4,367,876 to Kotoyori is directed to a pinball machine which has a CRT display unit taking up a portion of the backbox for indicating scores of the players. The Kotoyori patent also provides for multiple player scores to be displayed, with the score of the player presently playing preferably being displayed in a larger size than the scores of the other players. This display may also identify each of the displayed scores with a player by displaying such indications as "first player," "second player," etc. adjacent the scores.

U.S. Pat. No. 5,316,303 to Trudeau et al. is directed to a pinball game having a holographic display of a fixed image which is displayed through a transparent panel in the playfield. A light illuminating the image may be moved, and the plate upon which the image is mounted may also be flexed or otherwise moved, to cause the image to appear to the player to move from left to right and/or toward and away from the player.

SUMMARY OF THE INVENTION

In accordance with one aspect of the invention, an amusement game incorporates both a pinball type playfield and a video display.

In accordance with another aspect of the invention, such an amusement game includes a visual image projected as a virtual image in association with the playfield.

In accordance with another aspect of the invention, in such an amusement game, the projected image is interactive with features of the pinball type game.

In accordance with another aspect of the invention, in such an amusement game, the content of the video display is selected and/or changed in accordance with the position of a ball or other game piece on the playfield.

An amusement game in accordance with yet another aspect of the invention comprises a playfield for supporting a game piece and having a plurality of play features, and means for projecting a changeable video image in association with the playfield.

In accordance with another aspect of the invention a method of operating an amusement game of the type having a playfield for supporting a game piece and having a plurality of play features, comprises the steps of storing a plurality of visual images, selecting one of the visual images for display, and projecting the visual image selected for display as a virtual image in association with the playfield.

In accordance with another aspect of the invention, an amusement game includes a playfield for supporting a game piece and having a plurality of play features, a source of video information, a video display, a controller coupled to said source of video information and to said video display for selecting video information from said source to be displayed upon said video display, and means for projecting video information displayed on said video display as a virtual image relative to said playfield.

DESCRIPTION OF ILLUSTRATIVE EMBODIMENTS

Figure 1:
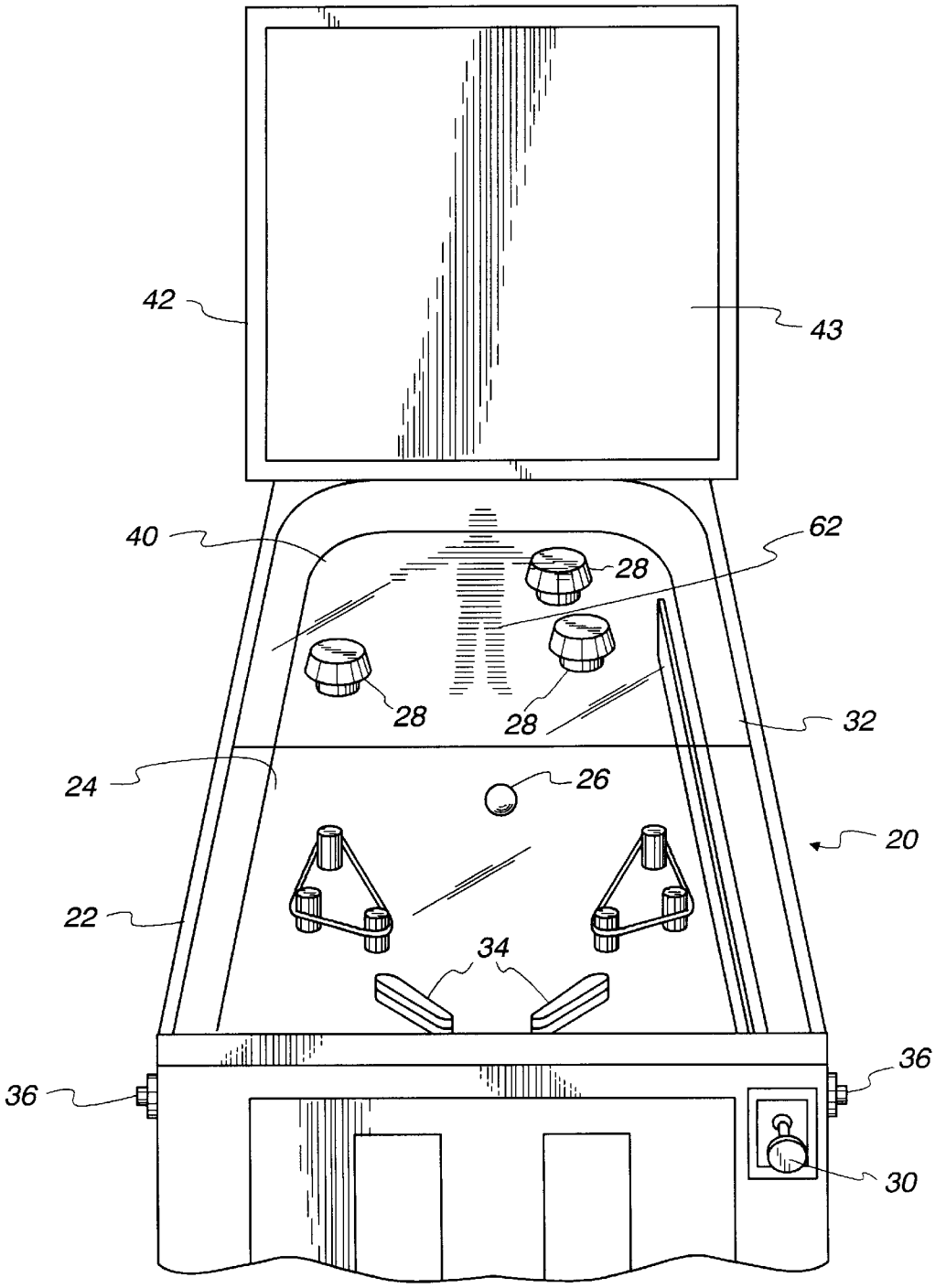
FIG. 1 is a front perspective view of amusement game in accordance with the invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Figure 2:
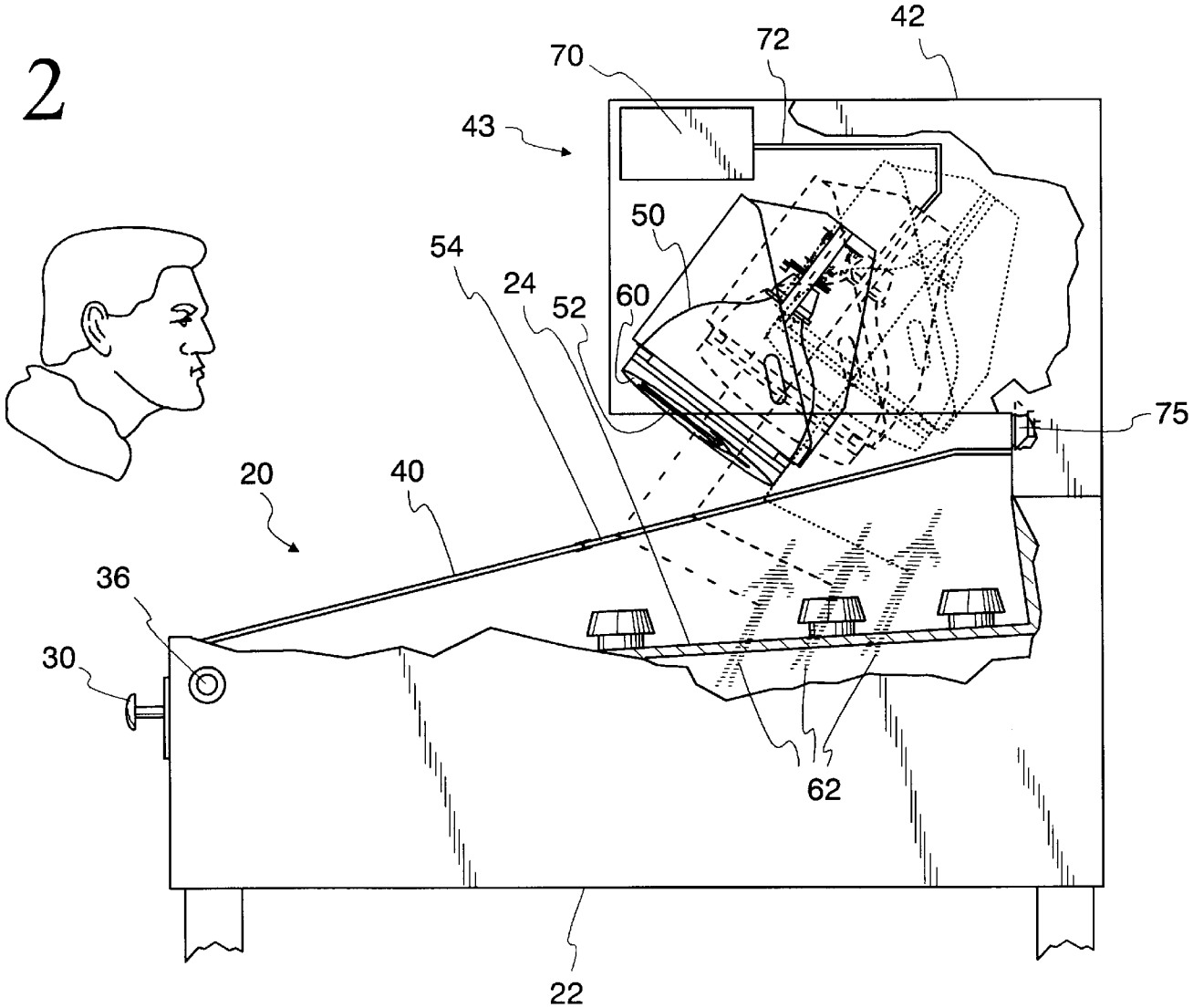
FIG. 2 is a side elevation, partially broken away and partially in section, of the amusement game of FIG. 1.

Referring now to the drawings, and initially to FIGS. 1 and 2, there is shown an amusement game in accordance with the present invention, and designated generally by the reference numeral 20. The amusement game 20 includes a cabinet 22 which houses a playing field or playfield 24 which may be inclined. The playing field 24 supports a game piece such as a rolling ball 26 and has a plurality of playfield features and devices. These features and devices may take a number of forms and some relatively simplified play features are indicated generally by reference numeral 28 in FIG. 1. The ball 26 may be initially introduced into the playfield 24 by shooting the ball 26 with a plunger element 30 up an alley 32. If the playfield 24 is inclined, as shown in FIG. 2, the ball tends to roll back generally in the direction of a pair of flippers 34 located at a bottom end part of the playfield 24. The flippers 34, which are activated by buttons 36 on the sides of the cabinet, are used by the skilled player to propel the ball back into the playfield 24. The playfield devices and features 28 may include a number of elements such as bumpers (as shown) as well as other elements not shown in FIG. 1. These other elements may include, without limitation, targets, various lights or other illumination devices, three-dimensional objects or figures, targets which are fixed or moveable, and so-called pop-up targets which are mounted generally below the surface of the playfield and may be selectively extended or retracted relative to the playfield. Other elements not shown in FIG. 1 may also be used, such as lanes, ramps, elements which are capable of selectively holding and releasing the ball, etc. Other types of playfield features or devices might be utilized without departing from the invention, the foregoing being by way of example only.

The playfield 24 is generally covered by a transparent panel 40 of glass or plastic through which a player may view the playfield 24 and its contents. A backbox 42 is mounted generally above the playfield and usually at an end thereof opposite a player station which is adjacent the location of the flippers 34 and plunger 30. Flipper control buttons 36 are also usually provided at the sides of the cabinet 22 for controlling the operation of the flippers 34.

The above-described features are usually found in various pinball games. Referring to FIG. 2, departing from convention, the backbox 42 mounts a cathode ray tube (CRT) 50 or functionally equivalent structure such as one or more rows or a grid of LED's, or a flat screen video display device, or a video projector. The CRT 50 is mounted such that its screen 52 is directed generally in the direction of the playfield 24, that is, generally in the vertically downward orientation as indicated in FIG. 2. Cooperatively, a portion 54 of the transparent panel 40 which is aligned with the image surface or screen 52 of the CRT 50 thereabove is constructed of material that has both transparent and reflective properties. For example, the panel portion 54 may be constructed of tinted glass or plastic. Advantageously, the relative orientations or angular offsets of the CRT screen 52 and the panel 54 are such that an image 60 appearing on the screen 52 will be projected as a virtual image 62 into the cabinet 22 in association with the playfield 24. In the illustrated embodiment, these relative angles and positions of the CRT screen 52 and the panel 54 are such that the virtual image appears to be projecting in a generally vertical direction intersecting with or projecting out of the playfield 24 as indicated in FIGS. 1 and 2. FIG. 2 shows three different positions of the CRT 50 and corresponding positions of the virtual image 6, to illustrate how the position of the virtual image may be moved back and forth relative to the playfield. It will be appreciated that the angular orientation of the virtual image 62 relative to the playfield 24 may also be varied as desired by varying the angle of the CRT or other device. The same considerations of spacing, angles and relative positions apply, in order to obtain a virtual image at a desired position, where the image is provided by apparatus other than or in addition to a CRT, such as a video projector, rows or grids of LED's, etc.

The image 62 projected into the playfield 24 may be a two dimensional image or a three-dimensional image, if desired, such that the virtual image 62 may have components which appear to be in a single plane intersecting the playfield or which appear to be in any number of positions behind the plane of the image 62 shown in FIGS. 1 and 2. Additional images in other positions, including in front of this plane, could be provided by a second image producing apparatus (such as a second CRT, a row or grid of LED's, a flat screen device, or a video projector) mounted adjacent the CRT 50, and located relative to the surface 54 to produce the added or second image at the desired location. Moreover, the virtual image 62 may include a virtual image of a game piece or ball. In the same manner, the virtual image 62 may include a playfield or playfield features. The virtual image 62 projected into the playfield from the CRT 50 may include fixed or moving images, video displays, scoring and/or instructional displays, or a combination of such images and displays, as desired. A source of data or information for forming these images on the CRT screen 52 may be a computer or processor or controller device 70 mounted in the backbox 42 and one or more associated storage devices or sources from which the processor may select images (and audio effects information, if desired) for display (or reproduction). A cable 72 couples the controller 70 to the CRT 50. In connection with the processor or controller 70, various storage devices or other sources of images (and, if desired, corresponding audio information) may be used including, but not limited to, ROM, RAM and other forms of solid state memory device, either as a part of, or operatively coupled with the processor 70, as well as magnetic disk, optical disk, video disk, video tape, and the like and corresponding player units operatively coupled with the processor or controller 70. The images may also be imported from other sources by use of a modem or other means operatively connected with the processor 70, such as broadcast TV or satellite TV tuners, a cable TV hookup, or a proprietary cable feed, among other things. Any other source of video image information (and, if desired, corresponding audio information) might be utilized without departing from the invention. An audio or sound reproduction device such as a loudspeaker 75 may be provided for reproducing any desired audio effects.

In accordance with another feature of the invention, the image selected and projected by the CRT 50 (and, if desired, the production of audio effects) are interactive with the elements of the game, that is, with the game piece or ball, and/or with the devices and features on the playfield. For example, the position of the ball 26 or other game piece may be sensed in various ways as further described hereinbelow, such that the image may be selected, changed and varied interactively with the ongoing play of the game.

A number of examples of selecting and projecting an image (and, if desired, producing audio effects) interactively with the play of the game are shown in FIGS. 3–9 and described hereinbelow. It will be understood that these examples are given only for purposes of illustration and description and are not in any way to be taken as limiting the scope of the invention.

Figure 3:
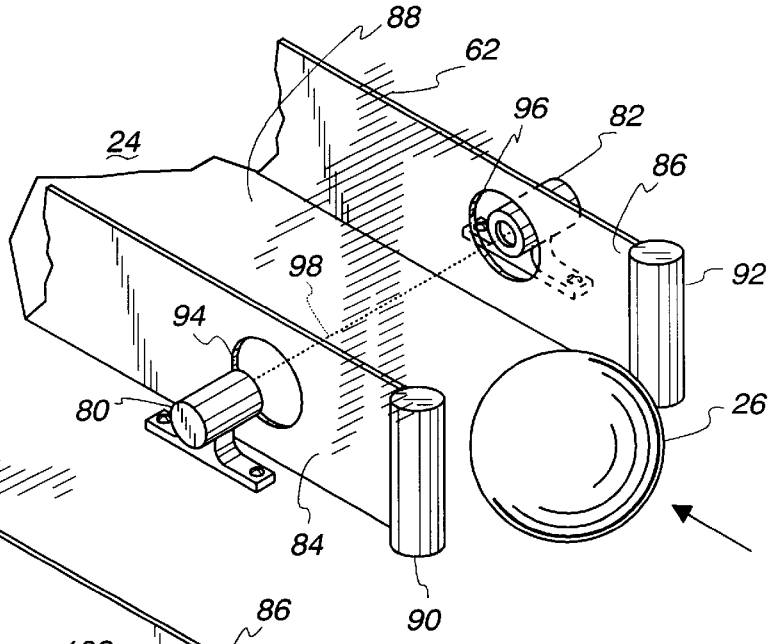
FIG. 3 is an enlarged fragmentary perspective view showing further details of the game in accordance with one embodiment of the invention.

Referring now to the remaining figures of drawings, and initially to FIG. 3, there is illustrated one example of a sensor arrangement for sensing the presence or absence of the ball 26 at a given location on the playfield and for producing a corresponding sensor signal. The processor or controller 70 is responsive to this sensor signal for selecting the content of the image projected as a virtual image 62 into the playfield area. In FIG. 3, the sensor takes the form of a light emitting device 80 and a light sensitive device 82 which are mounted to either side of, and in alignment with through openings 94 and 96, in a pair of elongate upright ball guide surfaces or walls 84, 86 which generally define a lane 88 therebetween. Respective posts 90 and 92 may support the respective guides 84 and 86 and attach to the playfield. In the illustrated embodiment, the light emitting device 80 is mounted directly to the surface of the playfield 24 and may be an infrared emitting device (IFR) such as a light emitting diode (LED). The light sensitive device 82 is also shown mounted to the playfield surface, and may be a photosensor such as a photosensitive diode or transistor. The photosensor is preferably mounted opposite and in alignment with the light emitting device 80, the openings 94, 96 being in alignment with each other and with the respective light emitting and light sensitive devices 80 and 82.

In operation, as the ball 26 passes up the lane 88 and breaks the light beam diagramatically indicated at reference numeral 98 between the light emitting device 80 and photosensitive device 82, a signal will be given to the controller for making some corresponding change or variation in the image 62. A corresponding audio effect may also be initiated by this interruption of the light beam 98 by the ball 26. The projected image 62 is shown in FIG. 3 located in the lane 88 generally in the plane of the beam 98; however, the image 62 may be located elsewhere without departing from the invention. Indeed, the image may have several components, only one of which is located as shown in FIG. 3. The same is true of the images 62 shown in each of FIGS. 4–7. The ball guide walls 84 and 86 form a convenient lane, such that a number of such lanes might be utilized in the game, with the passage of a ball into each lane triggering a different visual and audio (if desired) effect. Other segments or portions of the playfield might be defined by other arrangements of sensors, lanes, and the like in with different fashions without departing from the invention.

Figure 4:
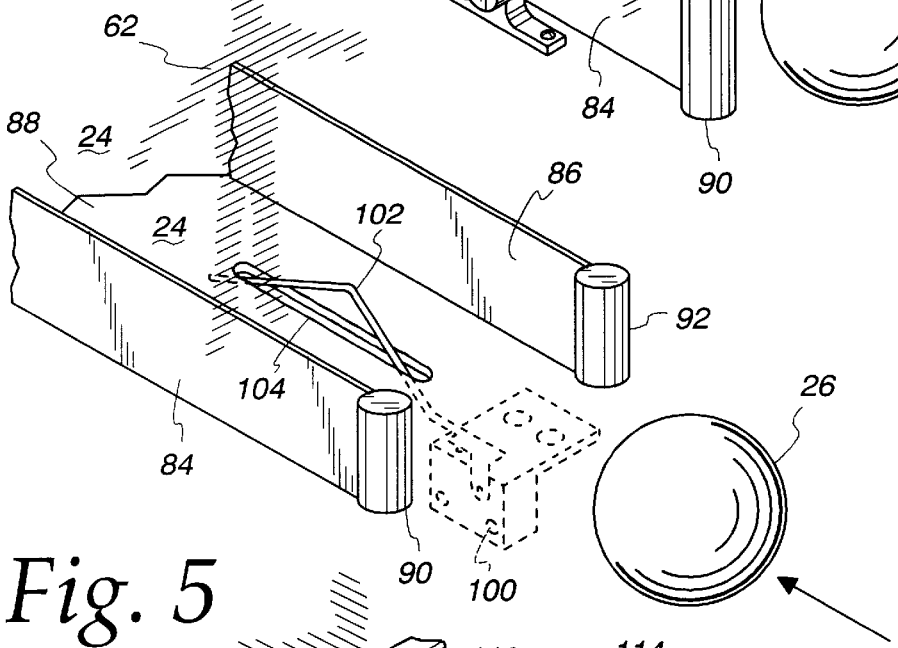
FIG. 4 is an enlarged fragmentary perspective view showing further details of the game in accordance with another embodiment of the invention.

Referring to FIG. 4, a so-called rollover microswitch is positioned in the lane 88 which is formed by similar ball guides 84, 86 supported at end posts 90 and 92 in the same fashion described above with reference to FIG. 3. Microswitch 100 may include a formed wire 102 which projects upwardly into the play area through a slot 104 provided for this purposes in the surface of the playfield 24. The image 62 may be projected generally in a plane which intersects the wire 102 of the switch 100. Thus, when the ball 26 passes over and deflects the wire 102, the switch 100 provides a useable signal to the processor 70 to trigger a corresponding visual and audio (if desired) effect, in the same manner described above with reference to FIG. 3.

Figure 5:
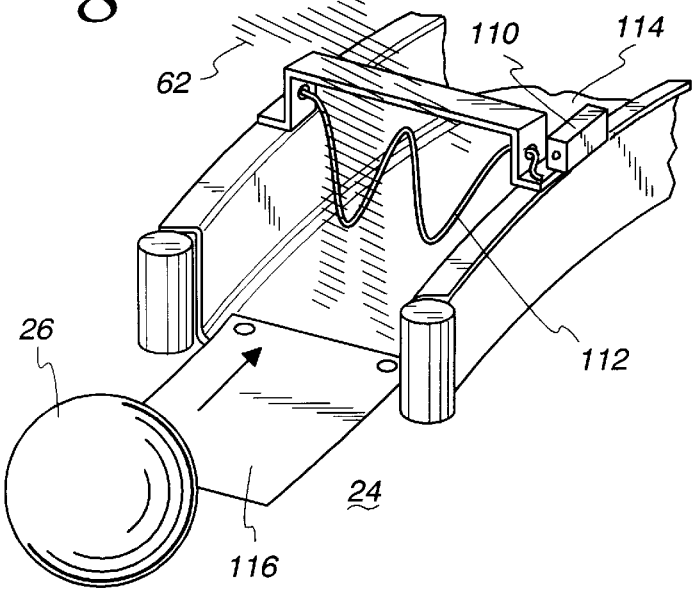
FIG. 5 is an enlarged fragmentary perspective view showing further details of the game in accordance with another embodiment of the invention.

FIG. 5 shows a ball position sensor in the form of a rollunder switch or gate 110 which has a formed wire or actuator member 112 which extends into a lane or ramp 114. The lane or ramp 114 as illustrated in FIG. 5 is an elongated trough-like ramp 114 which begins at the surface of the playfield and is inclined upwardly and away from the surface point of the playfield 24. An entrance apron 116 extends from the front part of the ramp 114 to provide a smooth entrance for the ball 26. When the ball 26 reaches the wire actuator 112 of the microswitch 110, a signal will be given to the processor 70 which may cause the virtual image 62 to be varied or some other visual and audio (if desired) effects to be triggered or initiated. Again, the visual image 62 is indicated in FIG. 5 generally in the plane of the undeflected actuator 112, but may be in other locations or have other components if desired.

Figure 6:
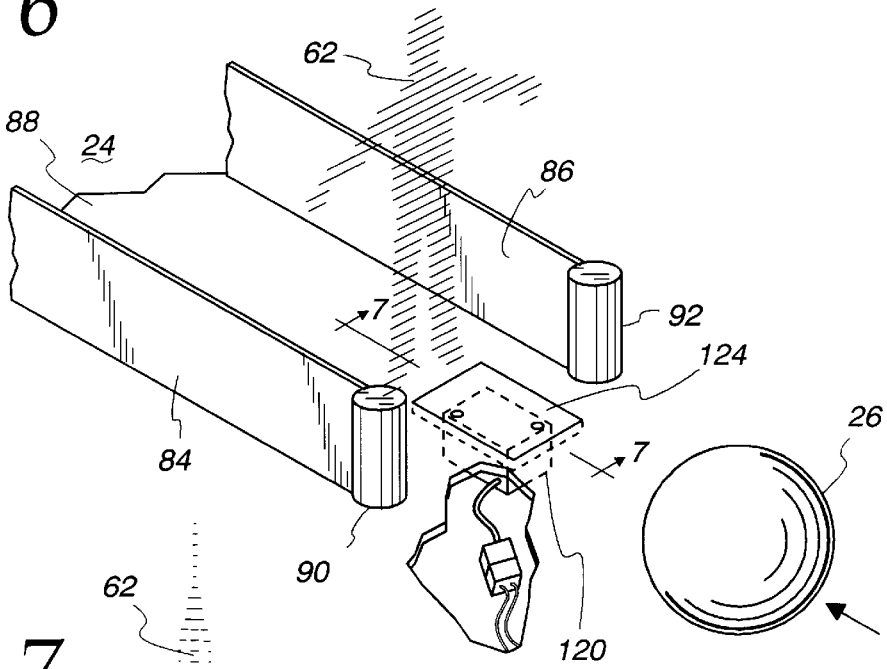
FIG. 6 is an enlarged fragmentary perspective view showing further details of the game in accordance with another embodiment of the invention.
Figure 7:
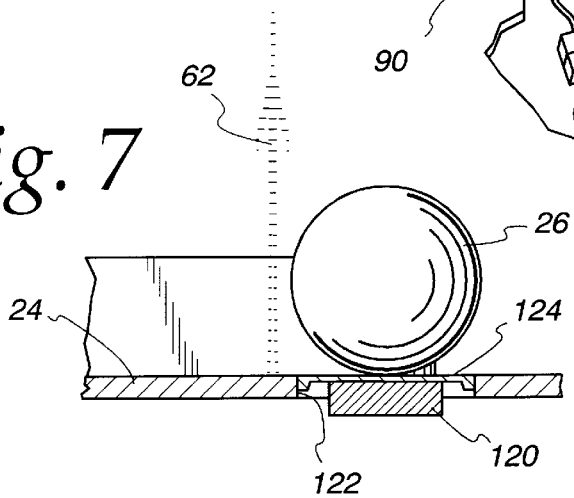
FIG. 7 is a partial side elevation, partially in section, showing further details of the embodiment of FIG. 6.

Referring to FIGS. 6 and 7, yet another form of sensing device or sensor in the form of a reed switch or pressure sensitive switch 120 is illustrated. The reed switch 120 is mounted just below the surface of the playfield 24 and preferably in a recess 122. A relatively thin panel such as a plastic insert 124 may cover the recess or opening 122 in the playfield within which the switch 120 is mounted. FIG. 6 illustrates the switch in connection with similar guides 84, 86 which define a lane 88 in the playfield 24. This switch 120, as well as the switches of the embodiments of FIGS. 3 and 4 could also be mounted, if desired, in connection with the ramp such as the ramp 114 shown in FIG. 5, or could be mounted in some position on the playfield without a corresponding ramp or lane being defined, if desired.

Figure 8:
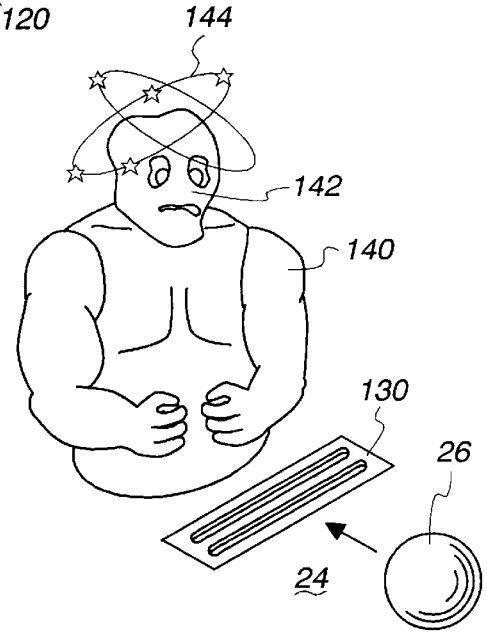
FIG. 8 is a fragmentary perspective view showing further details of the game in accordance with another embodiment of the invention.

Referring briefly to FIG. 8, other types of sensors might similarly be mounted just beneath the surface of the playfield 24, such as an eddy current sensor 130.

These various forms of sensors shown in the embodiments of FIGS. 3–7 may be utilized in connection with other playfield features or devices without departing from the invention. For example, in FIG. 8 a three-dimensional object or figure 140 comprises one such playfield feature or device. The figure 140 may be mounted in a fixed location relative to the sensor 130, such that when the ball 26 is sensed passing by the sensor 130 visual activity and (if desired) audio effects are triggered in connection with the figure 140. This may include mechanical movement of one or more portions of the figure 140 as well as the projection of a virtual image onto or adjacent to the figure 140. As illustrated in FIG. 8, the three-dimensional figure 140 has a face 142 upon which different facial features or expressions may be projected as a virtual video image. Thus, the facial features may noticeably change as the ball strikes the figure 140 (as sensed by the sensor 130), for example. Additional virtual video effects may also appear in a three-dimensional (3-D) image form, such as stars circling the head of the figure 140, as indicated generally at reference numeral 144 in FIG. 8. The figure 140 could alternately be a two-dimensional figure and/or partially formed as a virtual visual image, without departing from the invention.

Figure 9:
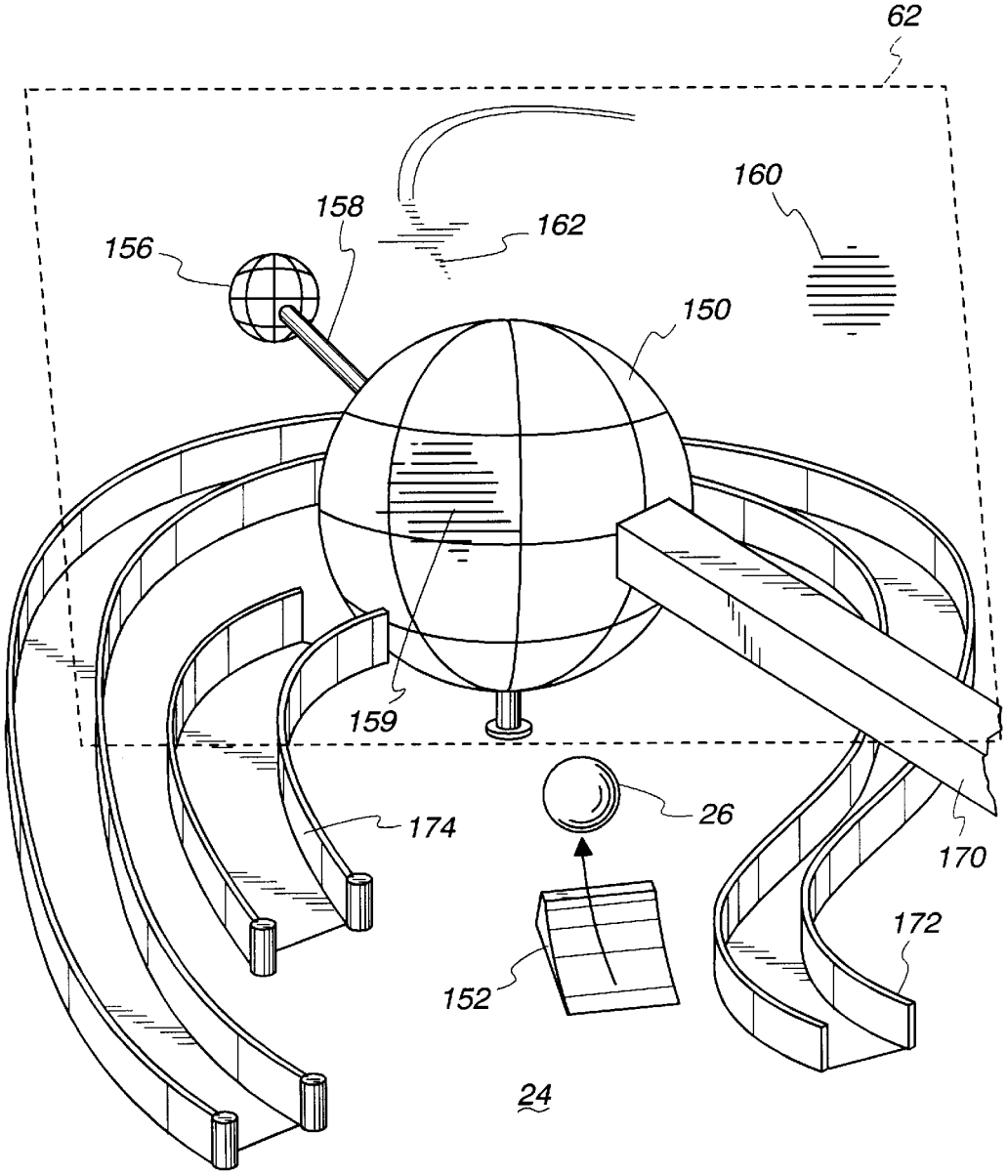
FIG. 9 is a partial perspective view showing further details of still another embodiment of the invention.

Referring also to FIG. 9, various combinations of ramps and lanes provided with various sensing devices or switches, for example, of the types illustrated in FIGS. 3–8, might be utilized within the scope of the invention. Moreover, various combinations of two- or three-dimensional objects or figures in the playing field and virtual video effects projected into the playing field onto or in association with or adjacent to the three-dimensional objects may be utilized. Thus, for example, FIG. 9 illustrates a playfield 24 which includes a three-dimensional object in the form of a three-dimensional "planet" 150 which may be a molded plastic object. One or more sensor devices (not shown) may be used in connection with the three-dimensional object 150 to trigger additional projected images, such as an "explosion" 159 projected upon the surface of the planet 150. In the embodiment shown, a ramp 152 "launches" the ball 26 at the planet to cause the "explosion" 159 to be displayed.

The processor or controller 70 can be programmed to take into account the relative position and speed of the ball (for example by measuring the time during which the beam of an optical sensor is broken) and implement suitable timing or time delays in initiating (and/or selecting) the responsive video image (and, if desired, audio effects), such as the "explosion" 159 on the planet 150.

Other projected images, or three-dimensional objects or various combinations thereof might be utilized in connection with the object or planet 150. For example, a secondary orbiting planet or satellite 156 might be a three-dimensional object which is physically connected with the planet or object 150, for example by a connecting element 158. Other satellites or other planets or similar elements might be a part of the virtual projected video image 62, for example, the virtual image planet 160 is shown in FIG. 9. Other virtual images, for example a spacecraft 162 might also be projected as a part of the image 62 in connection with the planet 150. The various portions 159, 160, 162 of the projected image 62 may appear in a single image plane or in multiple planes, or as 3D images.

The appearance or disappearance, movements, etc. of all of the projected image elements such as the explosion 159, the planet 160 and the spacecraft 162 might be in accordance with a preprogrammed sequence, which might be either a fixed sequence or triggered or run in connection with the sensed position of the ball 26 at various times during the play of the game. FIG. 9 also illustrates a number of additional playfield devices and features, such as various combinations of ramps and lanes 170, 172 and 174 in connection with the already described playfield features.

What has been illustrated and described herein is a novel amusement game wherein virtual images are projected in association with a playfield, in an interactive form with the play features and/or devices of the playfield. The amusement game may include various features for sensing the position of a ball on the playfield and for triggering various visual and audio affects. The playfield devices may include various devices for guiding or otherwise interacting with the ball, as well as various physical objects or figures upon which or in connection which the virtual video images may be projected. The projected images may also include other information such as scoring information, instructions for play of the game and the like.

What is claimed is:

1. An amusement game comprising:

a playfield having a plurality of play features;

a projection arrangement for projecting a virtual video image to appear to be superimposed upon said playfield, said virtual video image including a virtual video target;

a game piece moveable relative to said playfield;

at least one sensor for generating a sensor signal in response to sensing at least one of the presence and absence of said game piece at one or more predetermined locations on said playfield; and a controller, responsive in part to said sensor signal, for selecting the content of said virtual video image.

2. The game of claim 1 wherein said virtual video image intersects said playfield.

3. The game of claim 2 wherein said virtual video image is oriented generally vertically.

4. The game of claim 1 wherein said virtual video image is interactive with one or more of said play features.

5. The game of claim 4 wherein said virtual video image includes scoring information and instructional information.

6. The game of claim 1 wherein said playfield is mounted in a cabinet, and wherein said projection arrangement includes a video element and a panel, said video element being mounted generally above said cabinet, said panel having both transparent and reflective properties and overlaying at least a portion of said playfield in said cabinet, said video element and said panel being relatively positioned for projecting said virtual video image into said cabinet.

7. The game of claim 6 wherein said video element and said panel are arranged such that said virtual video image lies in a plane intersecting said playfield.

8. The game of claim 1 wherein said virtual video image is a three-dimensional image.

9. The game of claim 1 wherein said sensor generates said sensor signal in response to sensing a condition on the playfield.

10. The game of claim 1, wherein said sensor is proximate to said virtual video target.

11. The game of claim 1 wherein said sensor generates said sensor signal in response to sensing the presence of said game piece proximate to said virtual video target.

12. The game of claim 11 wherein said controller changes the appearance of said virtual video target in response to said sensor signal.

13. The game of claim 1 further including sound reproduction means and a source of audio information corresponding in a predetermined fashion to said virtual video image and a controller for selecting said corresponding audio information for reproduction by said sound reproduction means.

14. The game of claim 1 wherein said playfield is an inclined pinball playfield, and said game piece is a rolling ball.

15. The game of claim 1 wherein said plurality of play features include at least one physical object in said playfield and wherein said projection arrangement projects said virtual video image such that said virtual video image is proximate to a surface of said at least one physical object.

16. The amusement game of claim 1 wherein said plurality of play features include at least one physical object in said playfield and wherein said projection arrangement projects said virtual video image such that said virtual video image is adjacent to said physical object.

17. An amusement game comprising:

a playfield having a plurality of play features;

a projection arrangement for projecting a virtual image to appear to be superimposed upon said playfield, said virtual image including a dynamic virtual target moveable relative to said playfield;

a game piece moveable relative to said playfield;

at least one sensor for generating a sensor signal in response to sensing at least one of the presence and absence of said game piece at one or more predetermined locations on said playfield; and a controller, responsive in part to said sensor signal, for selecting the content of said virtual video image.

18. The game of claim 17 wherein said virtual image intersects said playfield.

19. The game of claim 18 wherein said virtual image is oriented generally vertically.

20. The game of claim 17 wherein said virtual image is interactive with one or more of said play features.

21. The game of claim 17 wherein said playfield is mounted in a cabinet, and wherein said projection arrangement includes a video element and a panel, said video element being mounted generally above said cabinet, said panel having both transparent and reflective properties and overlaying at least a portion of said playfield in said cabinet, said video element and said panel being relatively positioned for projecting said virtual image into said cabinet.

22. The game of claim 21 wherein said video element and said panel are arranged such that said virtual image lies in a plane intersecting said playfield.

23. The game of claim 17 wherein said virtual image is a three-dimensional image.

24. The game of claim 17 wherein said sensor generates said sensor signal in response to sensing a condition on the playfield.

25. The game of claim 17, wherein said sensor is proximate to said virtual target.

26. The game of claim 17 wherein said sensor generates said sensor signal in response to sensing the presence of said game piece proximate to said virtual video target.

27. The game of claim 26 wherein said controller changes the appearance of said virtual target in response to said sensor signal.

28. The game of claim 17 wherein said playfield is an inclined pinball playfield, and said game piece is a rolling ball.

29. The game of claim 17 wherein said plurality of play features include at least one physical object in said playfield and wherein said projection arrangement projects said virtual video image such that said virtual video image is proximate to a surface of said at least one physical object.

30. The game of claim 17 wherein said plurality of play features include at least one physical object in said playfield and wherein said projection arrangement projects said virtual video image such that said virtual video image is adjacent to said physical object.

31. A method of operating an amusement game including a game piece and a playfield having a plurality of play features, said method comprising:

displaying a video image on a video display;

projecting said displayed video image as a virtual image that appears to be superimposed upon said playfield, said virtual image including a virtual target;

propelling said game piece across said playfield;

sensing at least one of the presence and absence of said game piece at one or more predetermined locations on said playfield;

generating a sensor signal in response to sensing said at least one of the presence and absence of said game piece at said one or more predetermined locations on said playfield; and selecting the content of said video image partly in response to said sensor signal.

32. The method of claim 31 wherein the step of projecting includes projecting said virtual image intersecting with the playfield.

33. The method of claim 31 further including:

sensing a condition on said playfield; and generating said sensor signal in response to sensing said condition.

34. The method of claim 31 wherein said sensor is proximate to said virtual target.

35. The method of claim 31 further including:

sensing the presence of said game piece proximate to said virtual target; and generating said sensor signal in response to sensing the presence of said game piece proximate to said virtual target.

36. A pinball game comprising:

an inclined playfield having a plurality of play features;

a source of video information;

a video display;

a controller coupled to said source of video information and to said video display for selecting video information from said source to be displayed upon said video display; and a projection arrangement for projecting the video information displayed on said video display as a virtual image that appears to be superimposed upon said playfield, said virtual image including a virtual target;

a rolling ball moveable relative said playfield; and at least one sensor for generating a sensor signal in response to sensing at least one of the presence and absence of said rolling ball at one or more predetermined locations on said playfield, said controller selecting the video information from said source partly in response to said sensor signal.

37. The game of claim 36 wherein said sensor generates said sensor signal in response to sensing a condition on the playfield.

38. The game of claim 36 wherein said sensor is proximate to said virtual target.

39. The game of claim 36 wherein said sensor generates said sensor signal in response to sensing the presence of said rolling ball proximate to said virtual target.

40. The game of claim 36 wherein said plurality of play features include at least one physical object in said playfield and wherein said projection arrangement projects said virtual video image such that said virtual video image is proximate to a surface of said at least one physical object.

41. The game of claim 36 wherein said plurality of play features include at least one physical object in said playfield and wherein said projection arrangement projects said virtual video image such that said virtual video image is adjacent to said physical object.

42. An amusement game comprising:

a playfield having a plurality of play features;

means for displaying a video image;

means for projecting the displayed video image as a virtual image that appears to be superimposed upon said playfield, said virtual image including a virtual target;

a game piece moveable relative to said playfield;

means for sensing at least one of the presence and absence of said game piece at one or more predetermined locations on said playfield and generating a sensor signal in response thereto; and means, responsive in part to said sensor signal, for selecting the content of said video image.

43. The game of claim 42 wherein said sensing means generates said sensor signal in response to sensing at least one condition on said playfield.

44. The game of claim 42 wherein said sensing means is proximate to said virtual target.

45. The game of claim 42 wherein said sensing means generates said sensor signal in response to sensing the presence of said game piece proximate to said virtual target.

46. An amusement game comprising:

a playfield having a plurality of play features, said plurality of play features including a physical object;

a projection arrangement for projecting a virtual video image to appear to be superimposed upon said playfield and proximate to said physical object;

a game piece moveable relative to said playfield;

at least one sensor for generating a sensor signal in response to sensing at least one of the presence and absence of said game piece at one or more predetermined locations on said playfield; and a controller, responsive in part to said sensor signal, for selecting the content of said virtual video image.

47. The game of claim 46, wherein said virtual video image is proximate to a surface of said physical object.

48. The game of claim 46, wherein said virtual video image is adjacent to said physical object.

49. The game of claim 46 wherein said sensor generates said sensor signal in response to sensing the presence of said game piece proximate to said physical object.

* * * * *